US011299242B2

(12) United States Patent
Sporsheim

(10) Patent No.: US 11,299,242 B2
(45) Date of Patent: Apr. 12, 2022

(54) U-TANK ACTIVE ROLL DAMPENING SYSTEM FOR AND METHOD FOR ACTIVE ROLL DAMPENING OF A VESSEL

(71) Applicant: MRPC AS, Molde (NO)

(72) Inventor: Ove Sigbjörn Sporsheim, Molde (NO)

(73) Assignee: MRPC AS, Molde (NO)

( * ) Notice: Subject to any disclaimer, the term of this patent is extended or adjusted under 35 U.S.C. 154(b) by 4 days.

(21) Appl. No.: 16/959,194

(22) PCT Filed: Jan. 18, 2019

(86) PCT No.: PCT/NO2019/050011
§ 371 (c)(1),
(2) Date: Jun. 30, 2020

(87) PCT Pub. No.: WO2019/143257
PCT Pub. Date: Jul. 25, 2019

(65) Prior Publication Data

US 2020/0398950 A1 Dec. 24, 2020

(30) Foreign Application Priority Data

Jan. 19, 2018 (NO) ..... 20180092

(51) Int. Cl.
*B63B 39/03* (2006.01)
*B63B 79/40* (2020.01)

(52) U.S. Cl.
CPC ..... *B63B 39/03* (2013.01); *B63B 79/40* (2020.01)

(58) Field of Classification Search
CPC ..... B63B 39/00; B63B 39/03; B63B 43/00; B63B 43/06; B63B 79/40
USPC ..... 114/121, 122, 125
See application file for complete search history.

(56) References Cited

U.S. PATENT DOCUMENTS

| | | | | |
|---|---|---|---|---|
| 3,580,205 | A | 5/1971 | Bell | |
| 4,864,958 | A | 9/1989 | Belinsky | |
| 8,479,674 | B2 * | 7/2013 | Sporsheim | B63B 39/03 114/121 |

FOREIGN PATENT DOCUMENTS

| | | | |
|---|---|---|---|
| DE | 10045921 | A1 | 3/2002 |
| DE | 10315294 | A1 | 10/2004 |
| GB | 1156587 | | 7/1969 |
| GB | 2087818 | A | 6/1982 |
| KR | 20110074444 | A | 6/2011 |
| KR | 101541063 | B1 | 7/2015 |
| KR | 20160104884 | A | 9/2016 |

OTHER PUBLICATIONS

International Search Report and Written Opinion dated May 3, 2019 (PCT/NO2019/050011).
International Preliminary Report on Patentability dated Feb. 19, 2020 (PCT/NO2019/050011).

* cited by examiner

*Primary Examiner* — Lars A Olson
(74) *Attorney, Agent, or Firm* — Alix, Yale & Ristas, LLP

(57) ABSTRACT

U-tank active roll dampening system and method for active roll dampening of a vessel provided with a U-tank enabling controlling of fluid level in side tanks in anti-phase in front of vessel roll motion period.

20 Claims, 4 Drawing Sheets

U-TANK ACTIVE ROLL DAMPENING SYSTEM FOR AND METHOD FOR ACTIVE ROLL DAMPENING OF A VESSEL

BACKGROUND

The disclosed embodiments relate to a U-tank active roll dampening system for vessel and a method for active roll dampening of a vessel provided with a U-tank, according to the preamble of claim 10.

The use of U-tube tanks was pioneered by Frahm in Germany at the start of the 20th century and they are often referred to as Frahm tanks. These partially filled tanks consists of two side tanks connected at the bottom by a substantial crossover duct. The air columns above the liquid in the two tanks are also connected by a duct. As in the free surface tanks, as the ship begins to roll the fluid flows from side tank to side tank causing a time varying roll moment to the ship and with careful design this roll moment is of correct phasing to reduce the roll motion of the ship. They do not restrict fore and aft passage as space above and below the crossover duct is available for other purposes.

JP7251793A, KR20160104884A, KR101235329 B1 and KR20150045323A are examples of such a system where air supply means are arranged to both the side tanks, at upper end thereof.

There is also known to use a pump in the crossover duct to control the fluid volume in the side tanks.

These pumps have the problem to active transfer enough volume capacity for roll damping, but sufficient in "Anti-Heeling" system.

GB 1213853 A also describes a system as mentioned above requiring an upper connection of the side tanks to ensure that the air spaces above the liquid in both of the tanks are at the same pressure by a vent against atmospheric pressure. In GB 1213853 A a booster arrangement is arranged supplying air to both the side tanks, one at the time when controlled in relation to roll measurements. I.e. in GB 1213853 A the system works such that when supplying air to first side tank, the fluid level in the second tank rises, and when the fluid level in the second tank is to be lowered, air is supplied to the second tank, lowering the fluid level in the second tank and raising the fluid level in the first tank. Excess air is flowing back to reservoirs via the interconnecting duct at upper part of the two tanks. GB 1213853 A thus describes a closed system wherein each tank is connected to a booster arrangement via piping at upper part thereof. It is clearly stated in GB 1213853 A that the system cannot be classified as an active stabilizer, as the booster arrangement is incapable of providing a sufficient force to produce the necessary flow of liquid between the tanks in order to stabilize roll motion of the ship.

GB 2087818 A discloses a system similar to the system in GB 1213853 A working in the similar manner as GB 1213853 A and suffer from the same disadvantages as GB 1213853 A.

The mentioned U-tank systems are mainly designed for Anti-heeling when utilizing blowers at top of the tanks, but in addition these systems can provide passive roll dampening by means of free flow of fluid between the tanks as a result of the vessel roll motions, with full opening of tank airings between the top of the tanks, wherein the fluid flow is designed to the shortest roll period of the vessel. If the vessel should have a longer roll period the tank airings at top of the tanks are reduced for reducing the velocity of the fluid flow between the tanks. In such a passive roll dampening mode the system attempts to achieve the flow of fluid as close to 90 degrees after the vessel roll movement period.

Accordingly, prior art solutions fail to provide an active roll dampening and there is a need for a U-tank active roll dampening system for and method for active roll dampening of a vessel provided with a U-tank.

The prior art solutions further suffer from that they are not capable of providing the volume capacity or response time required to counteract the roll affection from waves before they have started to affect the vessel, only after, and accordingly will not be able to provide an active roll dampening of the vessel. Accordingly, prior art solution is not arranged or capable of moving sufficient fluid volume in advance, approximately 90 degrees in front of a roll motion.

SUMMARY

Provided herein is a U-tank active roll dampening system for and a method for active roll dampening of a vessel that partly or entirely solve the drawbacks of prior art.

Also provided is a U-tank active roll dampening system for and method for active roll dampening of a vessel enabling counteraction of roll motions on the vessel before the waves have started to affect the vessel.

Also provided herein is a U-tank active roll dampening system for and method for active roll dampening of a vessel enabling sufficient volume capacity capable of moving sufficient fluid volume between side tanks thereof in anti-phase in front of vessel roll motion period.

Also provided herein is a U-tank active roll dampening system for and method for active roll dampening of a vessel wherein controlling fluid level in one of the side tanks thereof also controls the fluid level in the other side tank.

Also provided herein is a U-tank active roll dampening system for and method for active roll dampening of a vessel that can make use of present U-tank system installed on vessel and used for anti-heeling.

Disclosed herein is an active roll dampening system for and method for active roll dampening of a vessel based on a U-tank. The U-tank is formed by a port side tank and a starboard side tank, the side tanks at upper end sealed and at lower end connected by a crossover duct, wherein the U-tank is partly filled with a fluid, which typically is water or seawater. The actual fluid volume inside the U-tank must be defined by the crew based on the actual loading of the vessel. The U-tank active roll dampening system further comprises at least one vacuum and air pressure manipulation unit arranged to upper part of an associated side tank and at least one aeration device against open air connected to upper part of the other side tank. According to the disclosure the at least one vacuum and air pressure manipulation unit is arranged to supply air pressure or vacuum on fluid surface in the associated side tank with the other side tank open for aeration to open air to control fluid level in both side tanks.

According to a second embodiment of the U-tank active roll dampening system, the at least one vacuum and air pressure manipulation unit is arranged to supply air pressure on fluid surface of the other side tank via a controllable valve. Accordingly, the other tank is connected to the pressure side of the vacuum and air pressure manipulation unit via the controllable valve. In this embodiment there are further arranged aeration devices to both the side tanks. This embodiment will be especially suitable for solutions where the fluid level difference between the two side tanks have to be larger than 5 meters, i.e. the fluid level in the side tank associated with the at least one vacuum and air pressure manipulation unit is to be higher than 5 meters above the fluid level in the other side tank. By this embodiment, after a fluid level difference of 5 meters is achieved, the aeration device of the side tank associated with the vacuum and air pressure manipulation unit is set open to air, while the aeration device of the other side tank is closed and wherein the vacuum and air pressure manipulation unit is set to supply air pressure on the fluid surface of other side tank, whereupon the fluid level will further be lowered in the other side tank and correspondingly increased in the side tank associated with the vacuum and air pressure manipulation unit. In an alternative embodiment at least one separate air pressure unit is connected to the other tank instead of the vacuum and air pressure manipulation unit for supplying pressure on the fluid surface in the other side tank.

In one embodiment of the U-tank active roll dampening system, the vacuum and air pressure manipulation unit comprises at least one vacuum and air pressure generation unit connected to a demand controlled ventilation unit enabling controlled switching between supply of vacuum or pressure. In an alternative embodiment two or more vacuum and air pressure generation units are connected to a common demand controlled ventilation unit. According to a further embodiment, the U-tank active roll dampening system comprises two or more of the vacuum and air pressure manipulation units arranged to the same side tank. This will enable different configurations as well as redundancy.

According to a further embodiment of the system, the vacuum and air pressure manipulation unit is provided with a valve for opening or closing the connection to the associated side tank and the aeration device(s) is/are provided with a valve for opening or closing the aeration to open air.

In a further embodiment of the U-tank active roll dampening system for vessel, the vacuum and air pressure manipulation unit is arranged for aeration against open air of the associated side tank. By this, the disclosed system can operate in passive mode. Alternatively a separate aeration device can be arranged for this.

By means of the mentioned valves of the vacuum and air pressure manipulation unit and aeration device(s), respectively, the system can operate in a stabilized mode locking the fluid level in the side tanks at a desired level by closing the mentioned valves.

According to the disclosure, the U-tank active roll dampening system comprises at least one fluid level sensors arranged in each of the side tanks for measuring fluid level in the associated tank.

The U-tank active roll dampening system for vessel further comprises a dedicated motion reference unit (MRU) for measuring accelerations of the vessel in a roll motion.

The U-tank active roll dampening system further comprises a control unit arranged for controlling the vacuum and air pressure manipulation unit and aeration device(s), as well as associated valves and further is provided with means and/or software for controlling the fluid level in the side tanks based on measurements by the dedicated motion reference unit and measurements from the fluid level sensors so as to control the fluid level in the respective side tanks in anti-phase in front of the vessel roll motion period, approximately 90 degrees in front of a roll motion period.

Accordingly, the disclosed embodiments provide a U-tank active roll dampening system capable of controlling fluid volume in the side tanks to move in anti-phase in front of the vessel roll motion period. Accordingly, the U-tank active roll dampening system according to the disclosure is capable of moving sufficient fluid volume from one of the side tanks to the other side tank approximately 90 degrees in front of a roll motion period, and by this counteracting the affection of a passing wave before the wave starts to affect the vessel.

There is no description or mentioning in prior art of this way to active roll dampening to counteract roll motion of a vessel.

The controlling of the system is plain, as the fluid level/volume in only one of the side tanks requires to be controlled, which directly affects the fluid level/volume in the other side tank. This reduces the space required in the vessel for arrangement of the system, as well reduces the number of components of the system, resulting in low maintenance and installation costs.

A method for active roll dampening of a vessel provided with a the U-tank comprises controlling fluid level in both the side tanks by supplying air pressure or vacuum by means of at least one vacuum and air pressure manipulation unit on fluid surface in an associated side tank and aeration against open air of the other side tank by means of an aeration device, and controlling the fluid level in both side tanks in anti-phase in front of vessel roll motion period.

According to a further embodiment, the method comprises controlling the fluid level in the side tanks based on measurements by a dedicated motion reference unit and measurements from fluid level sensors associated with the side tanks so as to control the fluid level in the respective side tank in anti-phase in front of vessel roll motion period, approximately 90 degrees in front of the vessel roll motion period.

According to a further embodiment, of the method comprises closing the aeration of the other side tank and opening for aeration of the side tank associated with the at least one vacuum and air pressure manipulation unit by means of at least one aeration device arranged thereto, and supplying pressure utilizing the at least one vacuum and air pressure manipulation unit or at least one separate air pressure unit on fluid surface of the other side tank when additional increasing of the fluid level in the side tank associated with the vacuum and air pressure manipulation unit is required.

In practice the fluid level in both the side tanks will attempt to maintain in horizontal even when the vessel is tilting. By adding sufficient amount of vacuum or overpressure in one of the side tanks, i.e. the side tank associated with the vacuum and air pressure manipulation unit, one is able to move the fluid rapidly enough that one achieve controlled roll dampening. The earlier, i.e. in front/advance, the movement of fluid between the two side tanks before the vessel movement has developed, the less fluid (amount/weight) is required for dampening the roll motion/angle.

Accordingly, the method and the control unit of the system will be arranged to use latest historical information from the dedicated motion reference unit regarding roll motion of the vessel, and based on this predict probable future next roll motion/sequence and based on this control the fluid level in the side tanks in front/advance of the affection of the waves on the vessel.

In addition to the above stated, the system can operate in passive roll dampening mode with aeration of both the side tanks such that fluid passively flows freely between the two side tanks. This will match the vessels minimum roll period. If this period is to be extended this will be done by controlling the opening of the valves of the vacuum and air pressure manipulation unit and aeration device.

The system can further be set in a stabilizing mode, wherein the present fluid level in the side tanks are locked by closing the valves of the vacuum and air pressure manipulation unit and aeration device(s).

The disclosed embodiments can further make use of tanks already present in the vessel, such as Anti-heeling system tanks, and make use of the same tank volumes.

Further preferable features and advantageous details of the present invention will appear from the following example description, claims and attached drawings.

BRIEF DESCRIPTION OF THE DRAWINGS

The present invention will below be described in further detail with references to the attached drawings, where.

DETAILED DESCRIPTION

Figure 1:
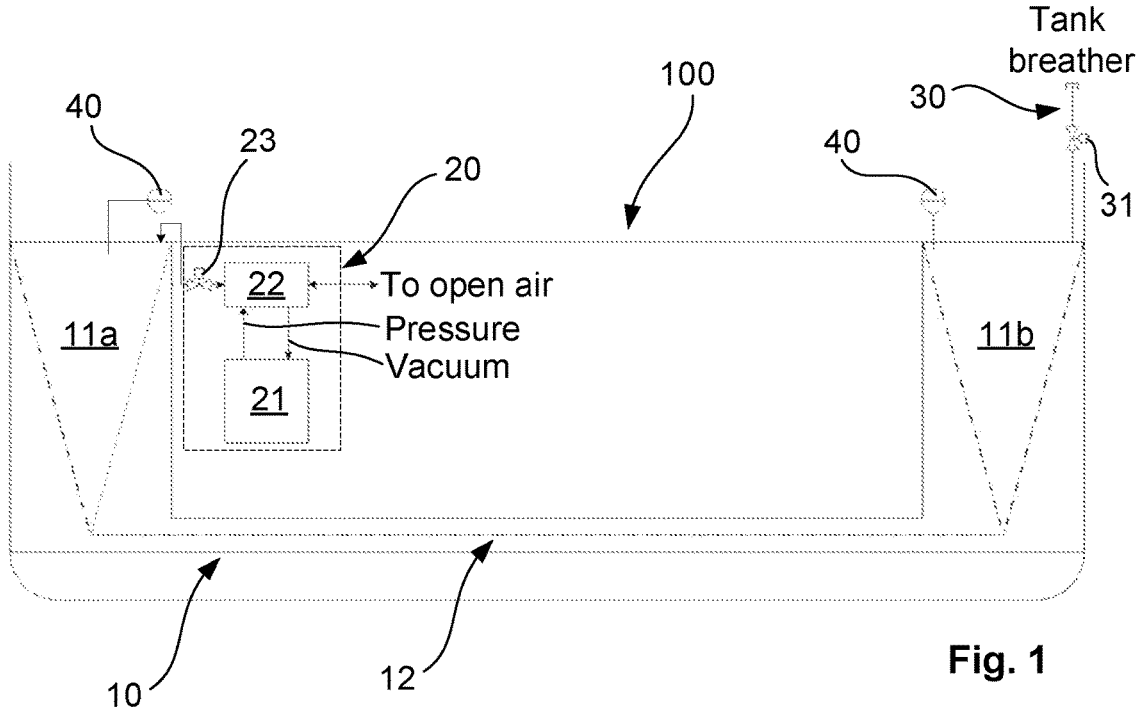
FIG. 1 is a principle drawing of a U-tank active roll dampening system for a vessel according to a first embodiment.

Reference is now made to FIG. 1 which is a principle drawing of a U-tank active roll dampening system for a vessel 100. The U-tank 10 is formed by a pair of side tanks 11*a-b*, one arranged on the starboard side of the vessel 100 and one arranged on port side of the vessel 100. The side tanks 11*a-b* are sealed at upper end and are at lower end connected by a crossover duct 12, thus forming a U-tank 10 inside the vessel 100. The U-tank 10 will initially be filled with a fluid volume that is defined based on actual loading of the vessel 100. This configuration of a U-tank 10 is well known for a skilled person. The crossover duct 12 will be designed to allow sufficient flow of fluid between the side tanks 11*a-b* to counteract a part of the roll movement within natural roll period of the vessel 100.

The mentioned side tanks 11*a-b* and crossover duct 12 thus form a closed fluid system in the vessel 100. In the disclosed embodiments, the only connection between the two side tanks 11*a-b* is the crossover duct 12.

The disclosed embodiments relate to how to use this known U-tank for active roll dampening of the vessel 100.

According to the disclosure, the system further comprises at least one vacuum and air pressure manipulation unit 20 connected to upper part of one of an associated side tank 11*a-b*, and an aeration device 30 connected to upper part of the other side tank 11*a-b*. In the shown example the vacuum and air pressure manipulation unit 20 is connected to the port side tank 11*a* and the aeration device 30 is connected to the starboard side tank 11*b*, but the vacuum and air pressure manipulation unit 20 can be connected to the starboard side tank 11*b* and the aeration device 30 to the port side tank 11*a*.

The vacuum and air pressure manipulation unit 20 comprises at least one vacuum and air pressure generation unit 21 connected to a demand controlled ventilation unit 22 connected to upper part of the interior of associated side tank 11*a* via a controllable valve 23. The vacuum and air pressure manipulation unit 20 is arranged to supply air pressure (overpressure) or vacuum (underpressure) on the fluid surface in the associated side tank 11*a*.

The aeration device 30 further comprises a controllable valve 31 for controlling the aeration of the mentioned side tank 11*b*.

Figure 2:
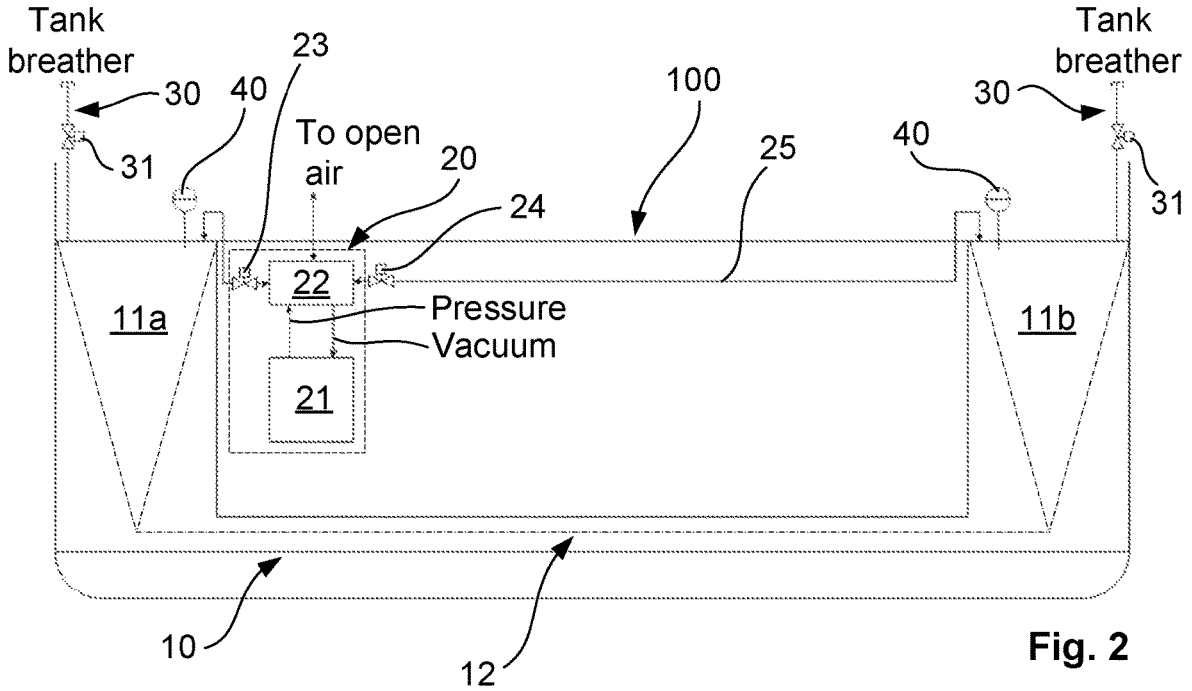
FIG. 2 is a principle drawing of a U-tank active roll dampening system for a vessel according to a second embodiment.

Reference is now made to FIG. 2 which is a principle drawing of a second embodiment of the U-tank active roll dampening system. In the second embodiment the at least one vacuum and air pressure manipulation unit 20 is in addition arranged to supply air pressure on fluid surface of the other side tank 11*b* via a controllable valve 24 and a pipe 25 extending from the pressure side of the vacuum and air pressure manipulation unit 20 to upper part of the other side tank 11*b*. In this embodiment there are further arranged aeration devices 30 to both the side tanks 11*a-b*. This embodiment will be especially suitable for solutions where the fluid level difference between the two side tanks 11*a-b* have to be larger than 5 meters, i.e. the fluid level in the associated side tank 11*a* is to be higher than 5 meters above the fluid level in the other side tank 11*b*. In an alternative embodiment at least one separate air pressure unit is arranged to upper part of the side tank 11*b* to supply pressure to the fluid surface therein in the same manner as the vacuum and air pressure manipulation unit 20 as described above.

Accordingly, the system provides a U-tank active roll dampening system that can operate both in a passive mode and in an active mode for performing roll damping. The system provides full control of fluid moving between the two side tanks 11*a-b*.

The system further comprises fluid level sensors 40 arranged in the side tanks 11*a-b* for reading/measuring current fluid level in the side tanks 11*a-b*.

Figure 3:
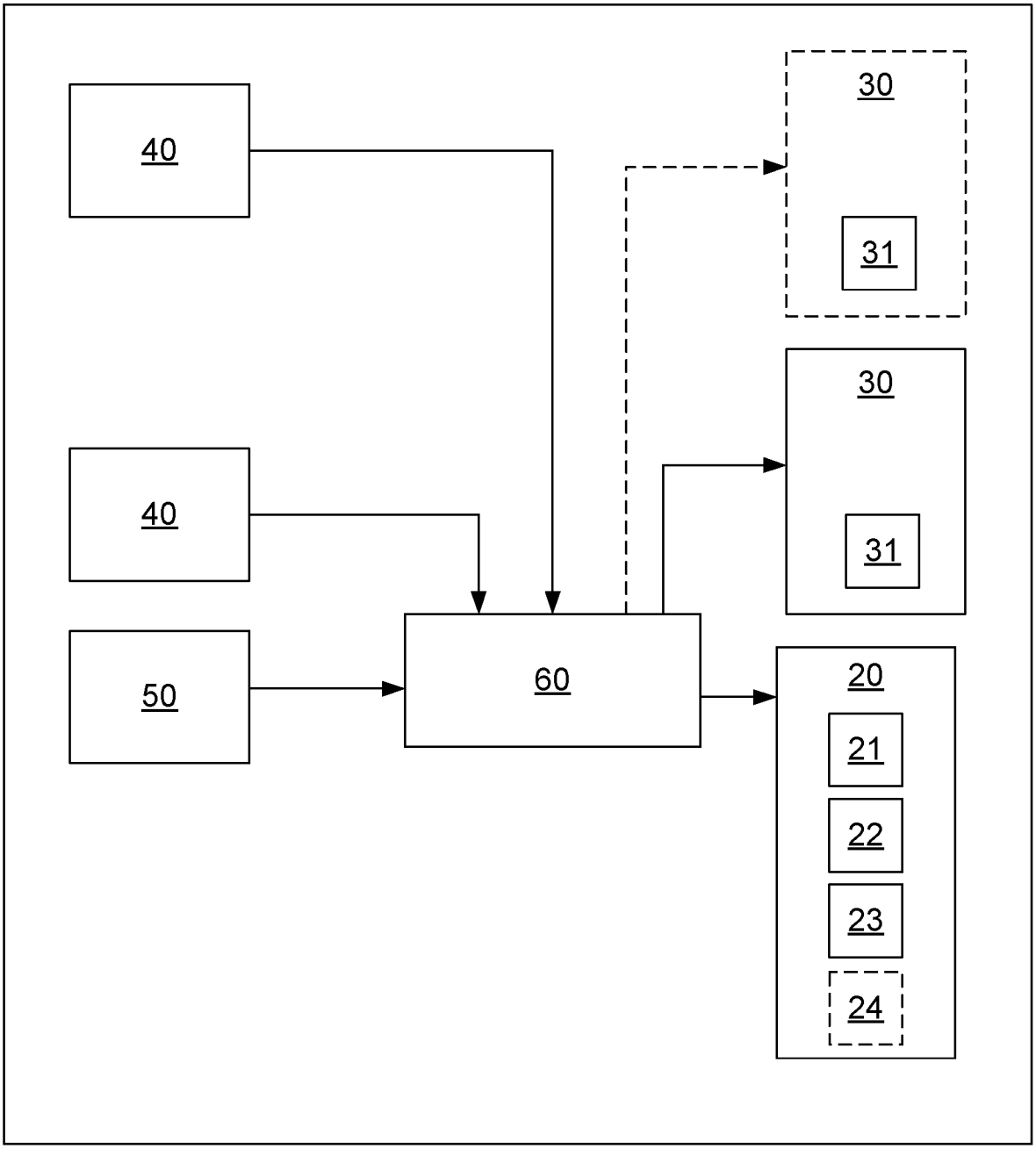
FIG. 3 is a block diagram of the system.

Reference is now made to FIG. 3 which is block diagram of a system according to the disclosure. The system further comprises a dedicated motion reference unit 50 for measuring accelerations of the vessel 100 in a roll motion, hereunder providing roll angle for the vessel which can be used for controlling of the fluid level/volume in the side tanks 11*a-b*.

The system further comprises a control unit 60 arranged for controlling the at least one air pressure manipulation unit 20, aeration device(s) 30 and valves 23, 31, 24. The control unit 60 is provided with means and/or software for controlling the vacuum and air pressure manipulation unit 20, aeration device(s) 30, as well as valves 23, 31, 24, based on operation mode, hereunder passive or active roll dampening, or stabilization mode.

In active mode the control unit 60 is arranged to set the aeration device 30 of the starboard side tank 11*b* open towards open air and the vacuum and air pressure manipulation unit 20 is set to supply air pressure or vacuum in the port side tank 11*a* based on measurement from the motion reference unit 50 and measurement of current fluid level in the side tanks 11*a-b* from the fluid level sensors 40. Accordingly, in active mode, instead of the fluid moving passively in relation to the vessel 100 motions and thus moving approximately 90 degrees behind the vessel roll motion, active control of the fluid movement is achieved by means of the system, and able to move the fluid in the respective side tanks 11*a-b* in anti-phase in front/advance of the vessel roll motion period. By means the vacuum and air pressure manipulation unit 20 capability of supplying air pressure or vacuum on the fluid surface in the port side tank 11*a* one can control the fluid to move between the mentioned side tanks 11*a-b*. With the aeration device 30 of the starboard side tank 11*b* open against air and by supplying air pressure in the port side tank 11*a* the fluid level in port side tank 11*a* will be reduced by that the air pressure will force the fluid to move from the port side tank 11*a* via the crossover duct 12 to the starboard side tank 11*b*, thus correspondingly elevating the fluid level in the starboard side tank 11*b*. Similarly, with the aeration device 30 of the starboard side tank 11*b* open against air and by supplying vacuum to the fluid surface in the port side tank 11*a*, this will result in pressure difference between the mentioned side tanks 11*a-b* that will draw/force the fluid to move from the starboard side tank 11*b* to the port side tank 11*a* via the crossover duct 12, elevating the fluid level in port side tank 11*a* and reducing the fluid level in the starboard side tank 11*b*. Accordingly, by controlling the pressure on the fluid surface in the port side tank 11*a*, full control of the fluid level in both side tanks 11*a-b*, i.e. the entire U-tank is achieved in an active manner.

If a fluid difference of more than 5 meter is required, i.e. the fluid level in the port side tank 11*a* will have to be larger than 5 meters above the fluid level in the starboard side tank 11*b*, the above described second embodiment, as shown in FIG. 2, can be used in active mode. The second embodiment works as the first embodiment as described above, but when the fluid level difference of 5 meters is achieved, the aeration device 30 of the port side tank 11*a* is set open to air, while the aeration device 30 of the starboard side tank 11*b* is closed and wherein the vacuum and air pressure manipulation unit 20 is set to supply air pressure on the fluid surface of the starboard side tank 11*b*, whereupon the fluid level will further be lowered in the starboard side tank 11*b* and correspondingly increased in the port side tank 11*a*. For most vessels a fluid level difference of 5 meters between the side tanks 11*a-b* will provide sufficient roll dampening, but for larger vessel there might be a need for larger fluid level difference which can be achieved by the second embodiment.

The second embodiment will further result in that one more rapid can achieve the required pressure difference in the two side tanks 11*a-b* in a more rapid manner.

Accordingly, by measuring the accelerations of the vessel 100 in a roll motion, this information can be used to move the fluid between the side tanks 11*a*-b, i.e. the fluid level in the respective side tanks 11*a-b*, in anti-phase in front/advance of the vessel roll motion period. Based on the measurements of the motion reference unit 50 the control unit 60 can predict and calculate the fluid level in the respective side tanks 11*a-b* such that the fluid level/volume can be controlled to be in anti-phase in front/advance of the vessel roll motion period. Accordingly, instead of the waves executing a force to the vessel weight (tonnage) in a certain roll motion, the system supplies a sufficient amount of fluid in the respective side tanks 11*a-b* in correct anti-phase point in time in front of the roll motion period (frequency) of the vessel 100, i.e. optimally moving the fluid level in the respective side tanks 11*a-b* approximately 90 degrees in front/advance of the vessel roll period.

Accordingly, by the controlled fluid flow between the side tanks 11*a-b* the affection from the waves on the vessel 100 can effectively be counteracted in an active manner by that the fluid is forced to flow from side tank 11*a-b* to side tank 11*a-b* counteracting the vessels roll motion, which will reduce the vessels roll considerably.

The control unit 60 is for this provided with means and/or software for software for controlling the fluid level in the side tanks 11*a-b* based on measurements by the dedicated motion reference unit 50 and measurements from the fluid level sensors 40 by calculating and provide optimal fluid level in the side tanks 11*a-b*.

By means of readings/measurements from the motion reference unit 50 of the vessel accelerations, the control unit 60 is arranged to calculate and provide optimal fluid level in the side tanks 11*a-b* based on input from a dedicated motion reference unit 50 measuring the vessel motion accelerations and in this way capable of setting the fluid level in anti-phase in front of the vessel roll period.

Accordingly, the control unit 60 will be provided with means and/or software for using latest historical information from the dedicated motion reference unit 50 regarding roll motion of the vessel, and based on this predict probable future next roll motion/sequence and based on this control the fluid level in the side tanks 11*a-b* such that the fluid level is controlled in front/advance of the affection of the waves on the vessel.

The initial fluid volume inside the U-tank 10 must be defined by the crew based on the actual loading of the vessel 100.

The embodiments can utilize the same tank volumes as Anti-heeling systems already present on a vessel or the vessel can be provided with a U-tank.

In addition to the above described active mode, the system can also be set in a passive mode. In passive mode the control unit 60 will set the vacuum and air pressure manipulation unit 20 in aeration mode, where the port side tank 11*a* is set open towards air, and the aeration device 30 of the starboard side tank 11*b* is set open towards air. Accordingly, in passive mode the fluid can flow freely (passively) between the side tanks 11*a-b* via the crossover duct 12 according to the vessels minimum roll period, 90 degrees behind the roll motion period. If this period is to be extended, one can achieve this by controlling the valves 23 and 31 via the control unit 60. For the second embodiment also the aeration device 30 in the port side tank 11*a* can be used for this purpose.

The system can further be provided with a stabilization mode, wherein the control unit 60 is arranged to close the valve 23 of the air pressure manipulation unit 20 and valve 31 of the aeration unit 30 in starboard side tank 11*b* locking the current fluid level in the side tanks 11*a-b*. In the second embodiment also the aeration device 30 of the port side tank 11*a* have to be closed.

The U-tank 10 can further be arranged to a fluid supply and removal system for supply and removal of fluid in the U-tank 10, for changing the total fluid amount in the U-tank, which is well known in prior art and requires no further description herein.

The system can further be provided with two or more vacuum and air pressure manipulation units 20 and aeration devices 30, respectively, connected to the associated side tanks 11*a-b*, respectively, for redundancy. The vacuum and air pressure manipulation unit 20 can further be provided with two or more vacuum and air pressure generation units 21 connected to the same demand controlled ventilation unit 22 dimensioned for this. In an alternative embodiment the system can further comprise two or more vacuum and air pressure manipulation units 20 separately arranged to the same side tank 11*a* via separate valves 23 or via the same valve 23.

Figure 4A:
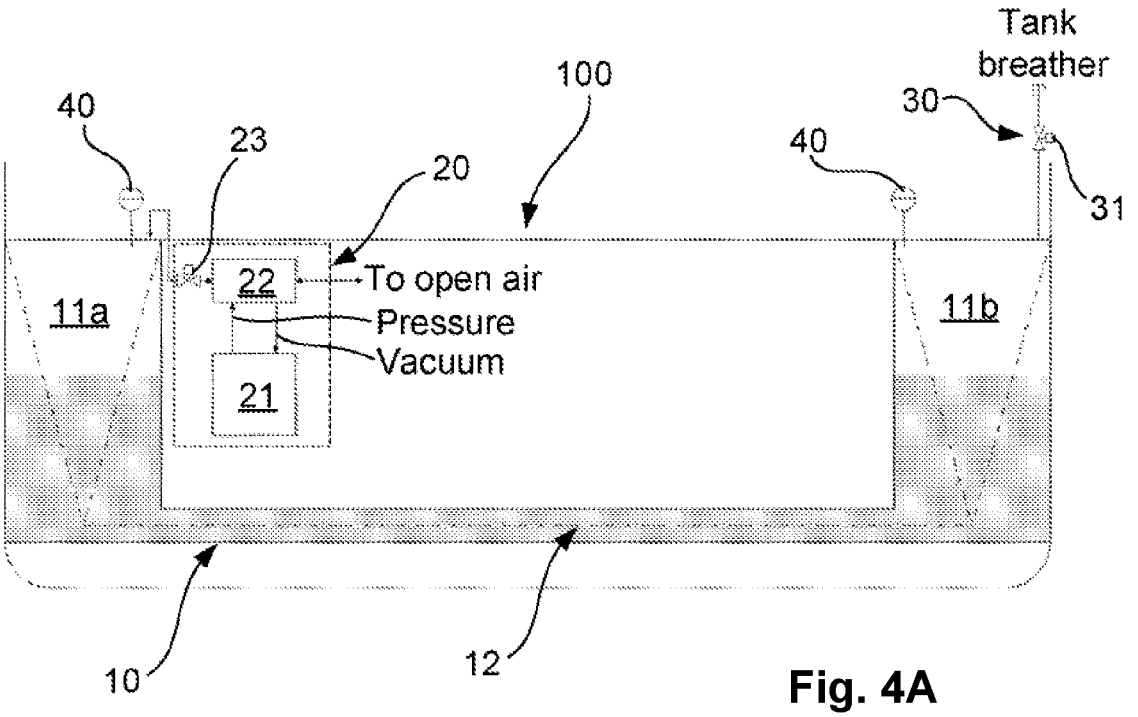
FIGS. 4A-4C are principle drawings of different states of the fluid level in the side tanks of the U-tank.

Reference is now made to FIG. 4A which show an initial state of fluid level in the side tanks 11*a-b* where the fluid level of in the port side tank 11*a* and the starboard side tank 11*b* are levelled, for the first embodiment. FIG. 4A could also represent a stabilized mode, where the valves 23 and 31 are closed. In connection with stabilized mode, the valves 23 and 31 can also be closed with different fluid levels in the port side tank 11*a* and starboard side tank 11*b* if desired.

Figure 4B:
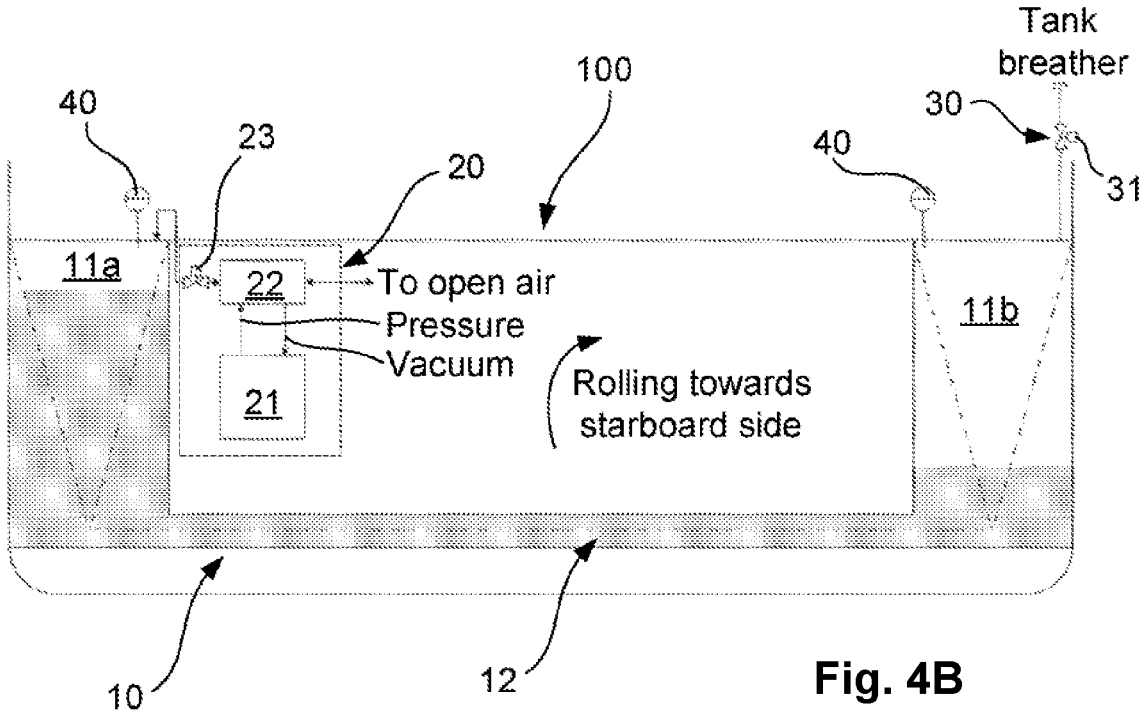

Reference is now made to FIG. 4B which show a state, for the first embodiment of the system, where the fluid level in port side tank 11*a* is elevated in relation to the fluid level in starboard side tank 11*b*, by that the vacuum and air pressure manipulation unit 20 supplies a vacuum on the fluid surface of the fluid in the port side tank 11*a*, resulting in a pressure difference between the side tanks 11*a-b* resulting in that fluid flows from the starboard tank 11*b* and into the port side tank

11*a*, and thus compensating for roll movements caused by a wave hitting on port side or a wave passing from starboard side.

Figure 4C:
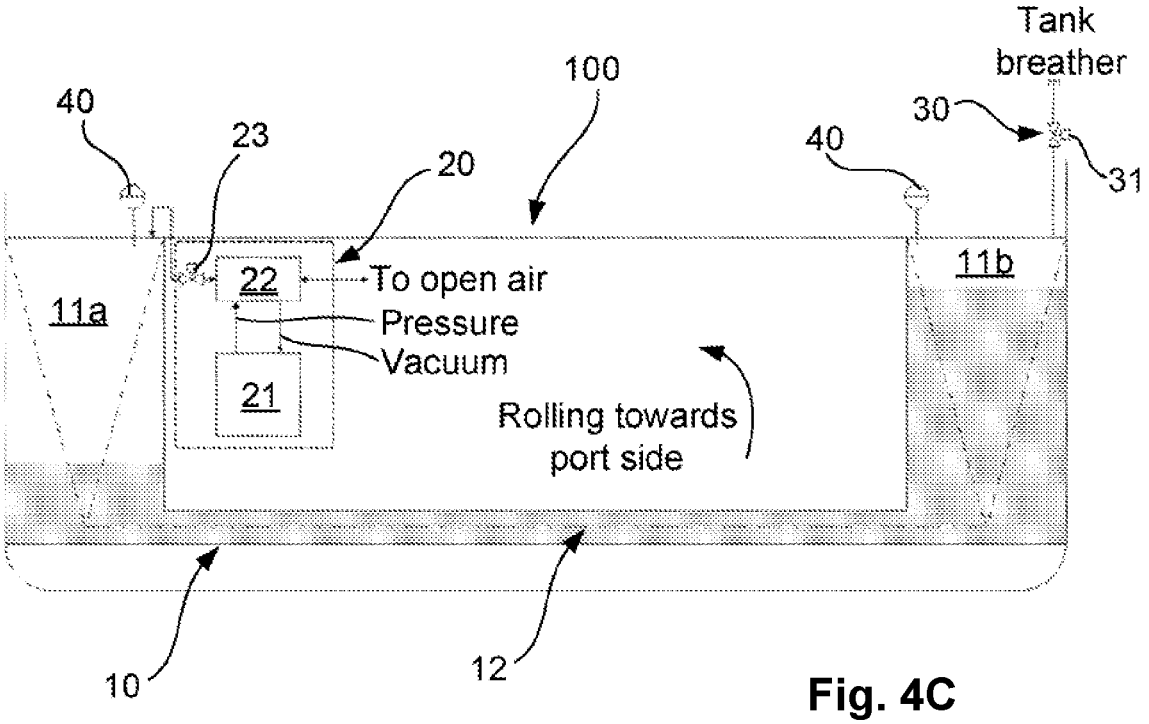

Reference is now made to FIG. 4C which show a state, for the first embodiment of the system, where the fluid level in starboard side tank 11*b* is elevated in relation to the fluid level in port side tank 11*a*, by that the vacuum and air pressure manipulation unit 20 supplies pressure on the fluid surface of the port side tank 11*a* forcing the fluid to flow to the starboard side tank 11*b*, reducing the fluid level in the port side tank 11*a* and elevating the fluid level in the starboard side tank 11*b*, and thus compensating for roll movement caused by a wave hitting on starboard side or a wave passing from port side.

Accordingly, by the disclosure provides a system where the fluid level in the respective side tanks 11*a-b* are set to be in anti-phase in front/advance of the vessel roll motion period, and optimally approximately 90 degrees in front/advance of roll motion period. The fluid level difference between the side tanks 11*a-b* will return to levelled with almost none use of energy due to the pressure difference between the side tanks 11*a-b*. Accordingly, the vacuum and air pressure manipulation unit 20 will only require power consumption for half of the required pressure difference, as the first half of the pressure difference can be achieved with the vacuum and air pressure manipulation unit 20 in idle running.

Further, by using air pressure and vacuum in only one of the side tanks for controlling the fluid level in both of the side tanks 11*a-b* this will results in only approx. 50% power requirement compared to prior art systems, as the disclosed embodiments will utilize the fluid height difference and will only have to perform half the work for moving the fluid volume from one side tank 11*a-b* to the other side tank 11*a-b* due to the use of the combination of pressure and vacuum.

The shape and volume of the side tanks 11*a-b* will have to be adapted the actual properties of vessel. Further, it will an advantage, that the tanks have large volume and that the system can operate with low pressure differences.

The above described embodiments can be combined to form alternative embodiments within the scope of the attached claims.

The invention claimed is:

1. A U-tank active roll dampening system for a vessel (100) defining a port side and a starboard side, comprising:

a U-tank formed by one side tank (11*a*) arranged at port side of the vessel (100) and one side tank (11*b*) arranged at starboard side of the vessel (100), each of the side tanks (11*a*, 11*b*) being sealed at its respective upper end and the side tanks (11*a*, 11*b*) being connected to one another by a crossover duct (12) at their bottom ends, the U-tank (10) being partially filled with a fluid, a motion reference unit (50) measuring accelerations of the vessel (100) roll motion, and a control unit (60), wherein at least one vacuum and air pressure manipulation unit (20) is arranged to an upper part of one of the respective side tanks (11*a*, 11*b*) and at least one aeration device (30) against open air is connected to an upper part of the other of the side tanks (11*a*, 11*b*), the at least one vacuum and air pressure manipulation unit (20) is configured to supply air pressure or vacuum on the fluid surface in the respective side tank (11*a*) to which it is arranged, and the control unit (60) includes one or both of software and means for controlling the at least one vacuum and air pressure manipulation unit (20) to thereby control a level of fluid in both of the side tanks (11*a*, 11*b*) in anti-phase in advance of vessel roll motion period by predicting and calculating a fluid level in the respective side tanks (11*a*, 11*b*) in anti-phase in advance of vessel roll motion period based on measurements of the motion reference unit (50).

2. The U-tank active roll dampening system according to claim 1, wherein the vacuum and air pressure manipulation unit (20) includes a valve (23) for opening or closing a connection of the vacuum and air pressure manipulation unit (20) to the respective side tank (11*a*, 11*b*) and the aeration device (30) includes a valve (31) for opening or closing aeration to open air.

3. The U-tank active roll dampening system according to claim 1, wherein the vacuum and air pressure manipulation unit (20) is arranged for aeration against open air of the associated side tank (11*a*, 11*b*).

4. The U-tank active roll dampening system according to claim 1, comprising at least one fluid level sensor (40) positioned in each of the side tanks (11*a*, 11*b*) for measuring fluid level in the respective side tank (11*a*, 11*b*).

5. The U-tank active roll dampening system according to claim 1, wherein the at least one vacuum and air pressure manipulation unit (20) is configured to supply air pressure on the fluid surface of the other side tank (11*a*, 11*b*) or at least one separate air pressure unit is arranged and configured to supply pressure on the fluid surface of the other side tank (11*a*, 11*b*), and aeration devices (30) are provided with controllable valves (31) for opening or closing the aeration to open air and are arranged to both side tanks (11*a*, 11*b*).

6. The U-tank active roll dampening system according to claim 2, wherein the at least one vacuum and air pressure manipulation unit (20) is configured to supply air pressure on the fluid surface of the other side tank (11*a*, 11*b*) or at least one separate air pressure unit is arranged and configured to supply pressure on the fluid surface of the other side tank (11*a*, 11*b*), and aeration devices (30) are provided with controllable valves (31) for opening or closing the aeration to open air and are arranged to both side tanks (11*a*, 11*b*).

7. The U-tank active roll dampening system according to claim 3, wherein the at least one vacuum and air pressure manipulation unit (20) is configured to supply air pressure on the fluid surface of the other side tank (11*a*, 11*b*) or at least one separate air pressure unit is arranged and configured to supply pressure on the fluid surface of the other side tank (11*a*, 11*b*), and aeration devices (30) are provided with controllable valves (31) for opening or closing the aeration to open air and are arranged to both side tanks (11*a*, 11*b*).

8. The U-tank active roll dampening system according to claim 4, wherein the at least one vacuum and air pressure manipulation unit (20) is configured to supply air pressure on the fluid surface of the other side tank (11*a*, 11*b*) or at least one separate air pressure unit is arranged and configured to supply pressure on the fluid surface of the other side tank (11*a*, 11*b*), and aeration devices (30) are provided with controllable valves (31) for opening or closing the aeration to open air and are arranged to both side tanks (11*a*, 11*b*).

9. The U-tank active roll dampening system according to claim 5, wherein the at least one vacuum and air pressure manipulation unit (20) is arranged to the other side tank (11*a*, 11*b*) via a controllable valve (24) and a pipe (25) extending from a pressure side of the vacuum and air pressure manipulation unit (20) to the upper part of the other side tank (11*a*, 11*b*).

10. The U-tank active roll dampening system according to claim 6, wherein the at least one vacuum and air pressure manipulation unit (20) is arranged to the other side tank (11*a*, 11*b*) via a controllable valve (24) and a pipe (25) extending from a pressure side of the vacuum and air pressure manipulation unit (20) to the upper part of the other side tank (11*a*, 11*b*).

11. The U-tank active roll dampening system according to claim 7, wherein the at least one vacuum and air pressure manipulation unit (20) is arranged to the other side tank (11*a*, 11*b*) via a controllable valve (24) and a pipe (25) extending from a pressure side of the vacuum and air pressure manipulation unit (20) to the upper part of the other side tank (11*a*, 11*b*).

12. The U-tank active roll dampening system according to claim 1, wherein the dedicated motion reference unit (50) measures accelerations of the vessel (100) in a roll motion.

13. The U-tank active roll dampening system according to claim 1, wherein the control unit (60) is configured to control the one or more aeration devices (30) and valves (23, 31, 24).

14. The U-tank active roll dampening system according to claim 1, wherein the vacuum and air pressure manipulation unit (20) comprises at least one vacuum and air pressure generation unit (21) connected to a demand controlled ventilation unit (22).

15. The U-tank active roll dampening system according to claim 2, wherein the vacuum and air pressure manipulation unit (20) comprises at least one vacuum and air pressure generation unit (21) connected to a demand controlled ventilation unit (22).

16. The U-tank active roll dampening system according to claim 5, wherein the vacuum and air pressure manipulation unit (20) comprises at least one vacuum and air pressure generation unit (21) connected to a demand controlled ventilation unit (22).

17. A method for active roll dampening of a vessel (100) defining a port side and a starboard side provided with a U-tank (10) formed by one side tank (11*a*, 11*b*) arranged at port side of the vessel (100) and another side tank (11*a*, 11*b*) arranged at starboard side of the vessel (100), the U-tank (10) being partially filled with a fluid, comprising the steps of:

measuring accelerations of the vessel (100) roll motion;

predicting and calculating the fluid level in both side tanks (11*a*, 11*b*) in anti-phase in advance of a vessel roll motion period based on the measurements, and controlling fluid level in both the side tanks (11*a*, 11*b*) in anti-phase in advance of a vessel roll motion period by supplying air pressure or vacuum via at least one vacuum and air pressure manipulation unit (20) on fluid surface in one of the respective side tanks (11*a*, 11*b*) and aeration against open air of the other of the respective side tanks (11*a*, 11*b*) via an aeration device (30), wherein each of the side tanks (11*a*, 11*b*) is sealed at its respective upper end and the side tanks (11*a*, 11*b*) are connected to one another by a crossover duct (12) at their respective bottom ends.

18. The method according to claim 17, comprising the steps of:

controlling the fluid level in the side tanks (11*a*, 11*b*) based on measurements by a dedicated motion reference unit (50) and measurements from the fluid level sensors (40) associated with the side tanks (11*a*, 11*b*) to control the fluid level in the respective side tank (11*a*, 11*b*) in anti-phase in advance of a vessel roll motion period.

19. The method according to claim 17, comprising the steps of:

closing the aeration of the other side tank (11*a*, 11*b*) and opening for aeration of the side tank (11*a*, 11*b*) associated with the at least one vacuum and air pressure manipulation unit (20) via at least one aeration device (30) arranged thereto, and supplying air pressure utilizing the at least one vacuum and air pressure manipulation unit (20) or at least one separate air pressure unit on fluid surface of the other side tank (11*a*, 11*b*) when additional increasing of the fluid level in the side tank (11*a*, 11*b*) associated with the vacuum and air pressure manipulation unit (20) is required.

20. The method according to claim 18, comprising the steps of:

closing the aeration of the other side tank (11*a*, 11*b*) and opening for aeration of the side tank (11*a*, 11*b*) associated with the at least one vacuum and air pressure manipulation unit (20) via at least one aeration device (30) arranged thereto, and supplying air pressure utilizing the at least one vacuum and air pressure manipulation unit (20) or at least one separate air pressure unit on fluid surface of the other side tank (11*a*, 11*b*) when additional increasing of the fluid level in the side tank (11*a*, 11*b*) associated with the vacuum and air pressure manipulation unit (20) is required.

* * * * *